US010308423B1

(12) United States Patent
Cui et al.

(10) Patent No.: US 10,308,423 B1
(45) Date of Patent: Jun. 4, 2019

(54) PORTABLE COLLAPSIBLE CONTAINER

(71) Applicants: Kan Cui, Mercer Island, WA (US); Margaret Cui Liu, Mercer Island, WA (US); Samuel Kan Liu, Mercer Island, WA (US)

(72) Inventors: Kan Cui, Mercer Island, WA (US); Margaret Cui Liu, Mercer Island, WA (US); Samuel Kan Liu, Mercer Island, WA (US)

( * ) Notice: Subject to any disclaimer, the term of this patent is extended or adjusted under 35 U.S.C. 154(b) by 0 days.

(21) Appl. No.: 16/233,052

(22) Filed: Dec. 26, 2018

(51) Int. Cl.

| | |
|---|---|
| ***B65D 6/18*** | (2006.01) |
| ***B65D 88/52*** | (2006.01) |
| ***B65D 88/00*** | (2006.01) |
| ***B65D 90/08*** | (2006.01) |
| ***B65D 90/02*** | (2019.01) |
| ***B65D 90/18*** | (2006.01) |

(52) U.S. Cl.
CPC ..... *B65D 88/524* (2013.01); *B65D 88/005* (2013.01); *B65D 90/027* (2013.01); *B65D 90/08* (2013.01); *B65D 90/18* (2013.01)

(58) Field of Classification Search
CPC .. B65D 21/086; B65D 88/005; B65D 90/027; B65D 90/08; B65D 88/524
USPC ..... 220/8, 6, 9.4, 9.3
See application file for complete search history.

(56) References Cited

U.S. PATENT DOCUMENTS

| | | | | |
|---|---|---|---|---|
| 844,955 | A * | 2/1907 | Morgan | |
| 2,725,087 | A | 11/1955 | Potter | |
| 2,952,379 | A | 9/1960 | Potter | |
| 3,084,825 | A * | 4/1963 | Hultquist | B65D 21/086 220/6 |
| 3,410,328 | A * | 11/1968 | Sasai | B65D 7/26 108/145 |
| 4,512,473 | A | 4/1985 | Thomaswick et al. | |
| 6,036,219 | A | 3/2000 | Oefelein et al. | |
| 6,550,491 | B1 | 4/2003 | Bixler et al. | |
| 9,738,298 | B1 | 8/2017 | Yang et al. | |
| 2003/0034636 | A1 | 2/2003 | Ng | |
| 2009/0206589 | A1 | 8/2009 | Osswald et al. | |
| 2014/0076643 | A1 | 3/2014 | Osswald et al. | |
| 2018/0194267 | A1 * | 7/2018 | Helou, Jr. | B64D 7/00 |

FOREIGN PATENT DOCUMENTS

| | | | |
|---|---|---|---|
| CN | 105015593 | A | 11/2015 |
| CN | 204775352 | U | 11/2015 |

* cited by examiner

*Primary Examiner* — Stephen J Castellano
(74) *Attorney, Agent, or Firm* — Richard C. Litman

(57) ABSTRACT

The portable collapsible container includes a collapsible frame assembly having a plurality of open frames and a plurality of scissor linkages. Adjacent ones of the open frames are adjustably coupled to one another by a respective one of the scissor linkages. The collapsible frame assembly further includes a plurality of hinged vertically extending panels mounted to and extending between adjacent open frames. A first cover member is secured to a first end frame and a second cover member is secured to a second end frame. A first end of an upper foldable panel is secured to an upper end of the first cover member, and a first end of a lower foldable panel is secured to a lower end of the first cover member. Pulling the second cover member away from the first cover member expands the collapsible frame assembly.

18 Claims, 10 Drawing Sheets

PORTABLE COLLAPSIBLE CONTAINER

BACKGROUND

I. FIELD

The disclosure of the present patent application relates to storage containers and the like, and particularly to a portable collapsible container that is selectively expandable and collapsible.

2. DESCRIPTION OF THE RELATED ART

Foldable and collapsible containers are relatively old and well known. Such containers are typically in the form of luggage or baggage, allowing a suitcase, briefcase or the like to be expanded to accommodate materials of different sizes to facilitate transport. Such containers typically have accordion-like, collapsible sidewalls positioned between conventional front and rear walls. As such, they are often limited in their versatility, i.e., although expandable and collapsible, they offer only slight variability in overall thickness, and are still limited to their basic functions and what can be carried within.

Although larger scale foldable and collapsible containers are known, such as collapsible truck trailers and shipping containers, the mechanical couplings required to expand and collapse these containers are typically very heavy and complex, often requiring the use of heavy machinery to manipulate the container. It would obviously be desirable to provide the diverse functionality of a collapsible container, but with greater versatility than exists with conventional collapsible luggage, and with far greater ease of use than exists with collapsible shipping containers, truck trailers and the like. Thus, a portable collapsible container solving the aforementioned problems is desired.

SUMMARY

The portable collapsible container includes a collapsible frame assembly having a plurality of open frames, a plurality of scissor linkages, and a plurality of hinged vertically extending panels. The open frames include opposed first and second end frames, which are positioned on either side of a set of inner frames. Adjacent open frames are adjustably coupled to one another by a respective scissor linkage.

Each scissor linkage includes first and second linkage members pivotally secured to one another, the first linkage member of each scissor linkage having opposed first and second ends, and the second linkage member of each scissor linkage also having opposed first and second ends. The first ends of the first and second linkage members are slidably mounted to one of the open frames, and the second ends are slidably mounted to a corresponding adjacent open frame. Additionally, a plurality of jib links may be provided, each jib link having opposed first and second ends, the first end of the jib link being pivotally attached to a central portion of the base end of one of the open frames, and the second end of the jib link being pivotally attached to a central portion of the first linkage member of a corresponding one of the scissor linkages.

Each of the hinged vertically extending panels is pivotally mounted to, and extends between, a pair of adjacent open frames. A first cover member is secured to the first end frame and a second cover member is secured to the second end frame. A first end of an upper foldable panel is secured to an upper end of the first cover member, and a first end of a lower foldable panel is secured to a lower end of the first cover member.

Pulling the second cover member away from the first cover member expands the collapsible frame assembly and deploys the plurality of hinged vertically extending panels to form sidewalls of the portable collapsible container. The upper and lower foldable panels may then be deployed to form the top wall and the bottom wall, respectively, of the portable collapsible container by pulling the respective second ends thereof in the direction of the second cover member. A linear actuator may be provided to drive expansion and collapse of the collapsible frame assembly.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
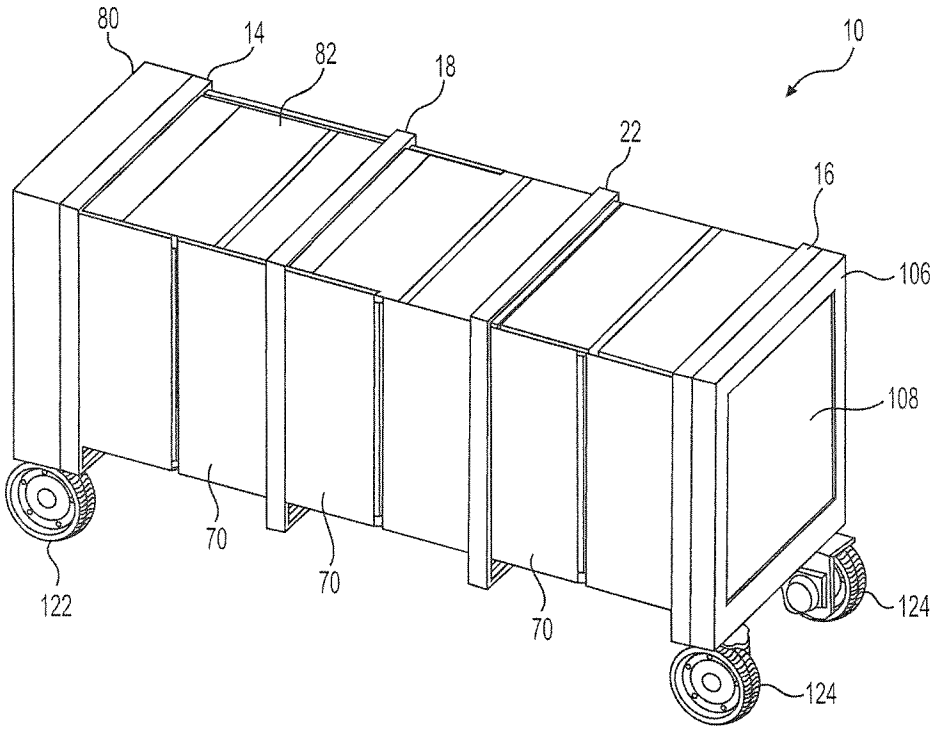
FIG. 1 is a perspective view of a portable collapsible container, shown in an expanded configuration.
Figure 2:
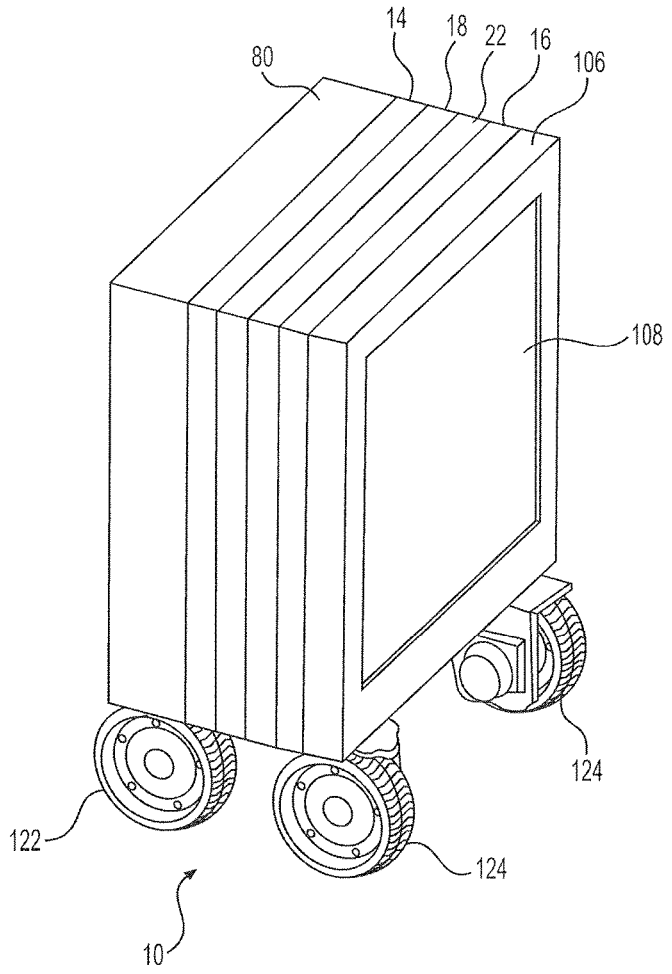
FIG. 2 is a perspective view of the portable collapsible container of FIG. 1, shown in a collapsed configuration.

The portable collapsible container 10 is an expandable and collapsible storage container. FIG. 1 shows the portable collapsible container 10 in a fully expanded condition, and FIG. 2 shows the portable collapsible container 10 in a relatively compact collapsed condition. It should be understood that the overall configuration and relative dimensions of the portable collapsible container 10, as shown in FIGS. 1 and 2, are shown for exemplary purposes only.

Figure 3:
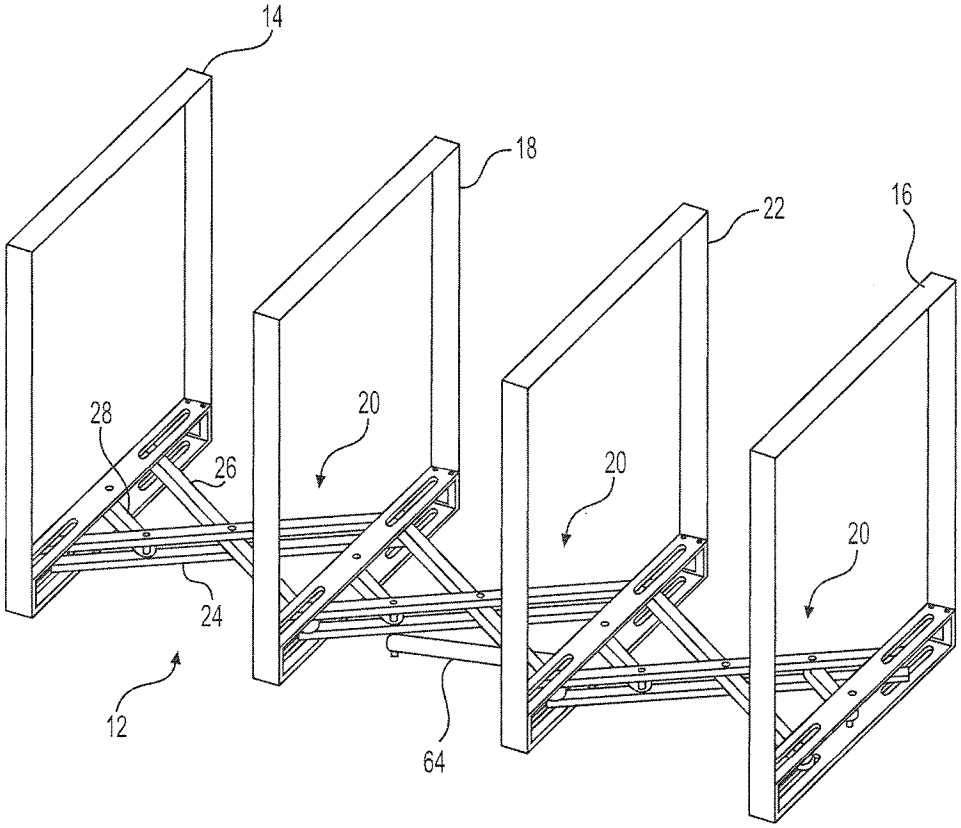
FIG. 3 is a perspective view of a collapsible frame assembly of the portable collapsible container of FIG. 1, showing the scissors linkage assembly extended.
Figure 4:
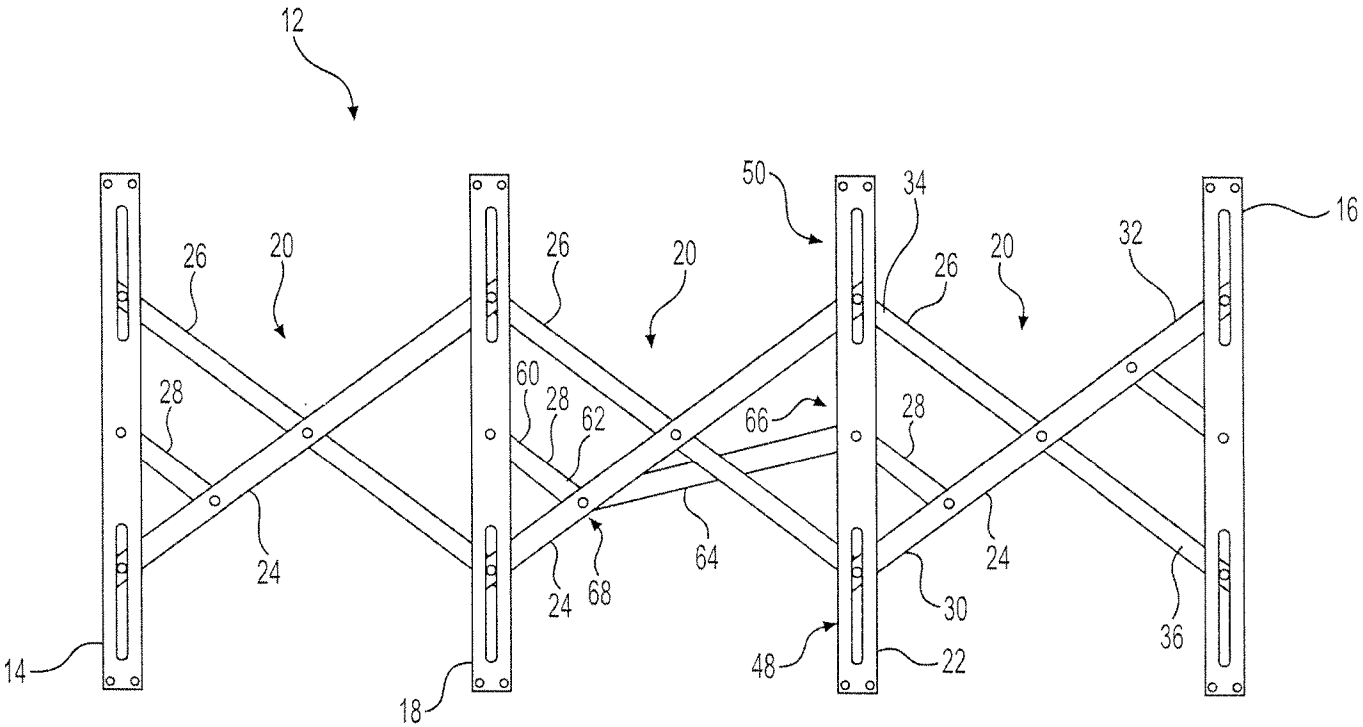
FIG. 4 is a top view of the collapsible frame assembly of FIG. 3, showing the scissors linkage assembly extended.
Figure 6:
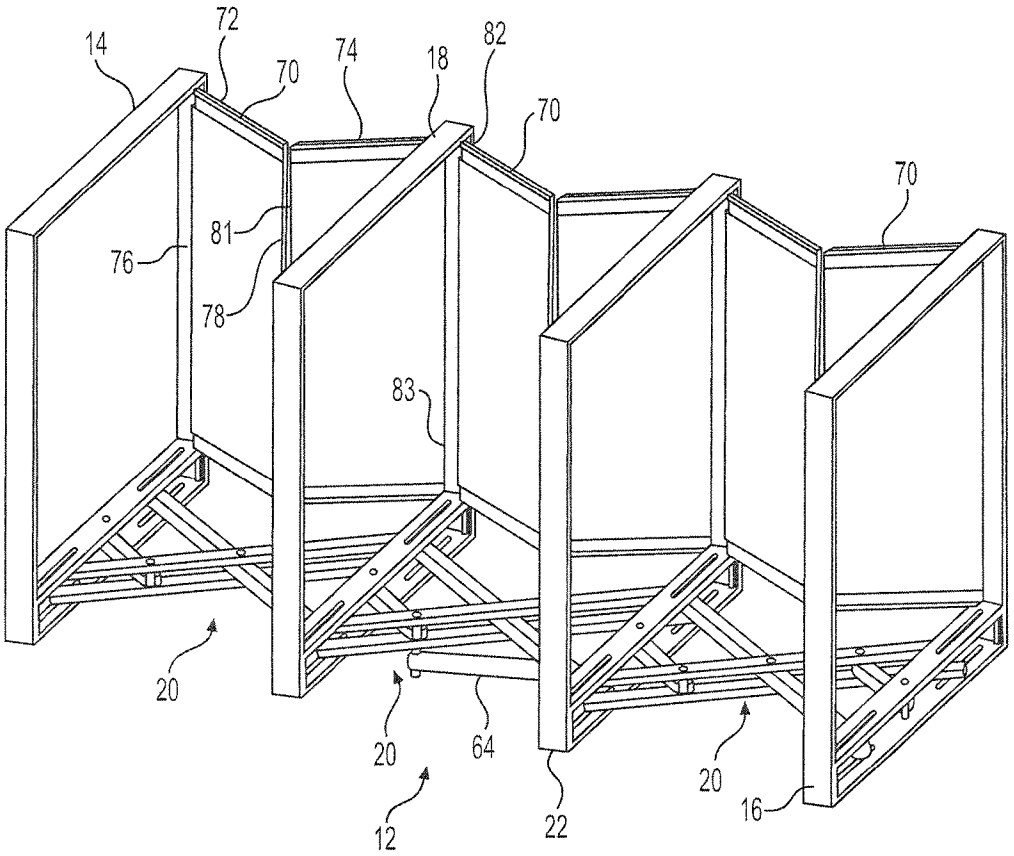
FIG. 6 is a perspective view of the collapsible frame assembly of FIGS. 3 and 4, showing the scissors linkage assembly extended and a single hinged sidewall mounted thereon to show details thereof.

As best seen in FIGS. 3, 4 and 6, the portable collapsible container 10 includes a collapsible frame assembly 12 having a plurality of open frames 14, 16, 18, 22, a plurality of scissor linkages 20, and a plurality of hinged vertically extending panels 70. The plurality of open frames include opposed first and second end frames 14, 16, respectively, which are positioned on either side of a set of inner frames 18, 22. Adjacent open frames are adjustably coupled to one another by a respective one of the scissor linkages 20.

Figure 5:
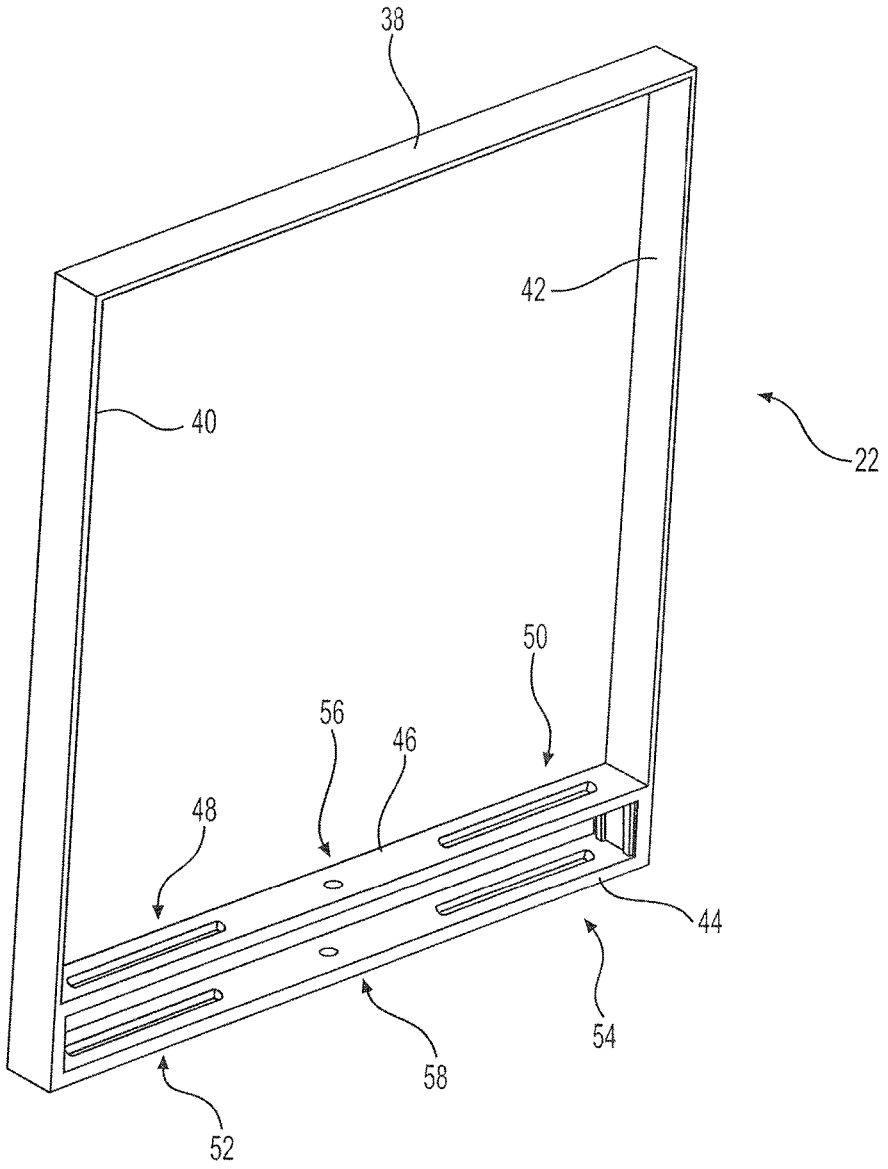
FIG. 5 is a perspective view of a single open frame of the collapsible frame assembly of FIGS. 3 and 4.

FIGS. 3 and 4 show four open frames 14, 16, 18, 22. However, it should be understood that any desired number of inner frames may be positioned between the first end frame 14 and the second end frame 16. In FIG. 3, each of the open frames 14, 16, 18, 22 is rectangular, and it should be understood that each open frame is identical in construction. As shown in FIG. 5 (which illustrates open frame 22), each open frame may include an upper end 38, a base end 44, and a pair of side members 40, 42.

Each scissor linkage 20 includes first and second linkage members 24, 26, respectively, which are pivotally secured to one another at their centers by a pivot pin or axle, as is conventionally known with single degree of freedom scissor linkages. The first linkage member 24 of each scissor linkage 20 has opposed first and second ends 30, 32, respectively, and the second linkage member 26 also has opposed first and second ends 34, 36, respectively. The first ends 30, 34 of the first and second linkage members 24, 26, respectively, are slidably mounted to one of the plurality of open frames (such as open frame 22 in FIG. 4, for example), and the second ends 32, 36 thereof are slidably mounted to a corresponding adjacent open frame (such as open frame 16 in FIG. 4).

As shown in FIG. 5, a bar 46 may be mounted adjacent and parallel to base end 44 of each open frame (open frame 22 in the example of FIG. 5), defining a channel for the ends of the scissor linkage members to slide in. A pair of horizontally extending slots 52, 54 may be formed through base end 44 and, as shown, a corresponding pair of horizontally extending slots 48, 50 may be formed through bar 46. As seen in FIG. 3, the first linkage member 24 of each scissor linkage 20 comprises a pair of parallel, spaced apart bars, while the second linkage member 26 of each scissor linkage 20 is a square or rectangular bar that slides between the spaced apart flat bars of the first linkage member. A pivot pin or retainer pin extends through the first end 30 of the first linkage members 24 and the second end 36 of the second linkage member of the scissors linkage 20 of the adjoining frame and is slidably mounted in slots 48, 52, and a pivot pin or retainer pin extends through the first end 34 of the second linkage member 26 and the second end 32 of the first linkage member of the scissors linkage of the adjoining frame and is slidably mounted in slots 50, 54. In this way, the scissors linkages 20 in consecutive frames are linked together so that the scissors linkages 20 expand and contract simultaneously to expand and contract the container 10.

As best seen in FIG. 4, the collapsible frame assembly 12 further includes a plurality of jib links 28. Each jib link 28 is one-quarter the length of the linkage members 24, 26 and has opposed first and second ends 60, 62, respectively, the first end 60 being pivotally attached by a pivot pin or axle to the center 32 of the base end 44 of one of the plurality of open frames (such as open frame 18, for example), and the second end 62 being pivotally attached by a pivot pin or axle to the first linkage member 24 of a corresponding one of the plurality of scissor linkages 20 about one-quarter of the length of the linkage member 24 from open frame 18, i.e., about midway between attachment of the first end 30 of linkage member 24 to the open frame 18 and the center pivot pin connecting linkage members 24 and 26. Referring again to FIG. 5, a pair of holes 56, 58 may be respectively formed through bar 46 and base end 44 for pivotal mounting of the first end 60 of jib link 28 to the open frame.

Figure 8:
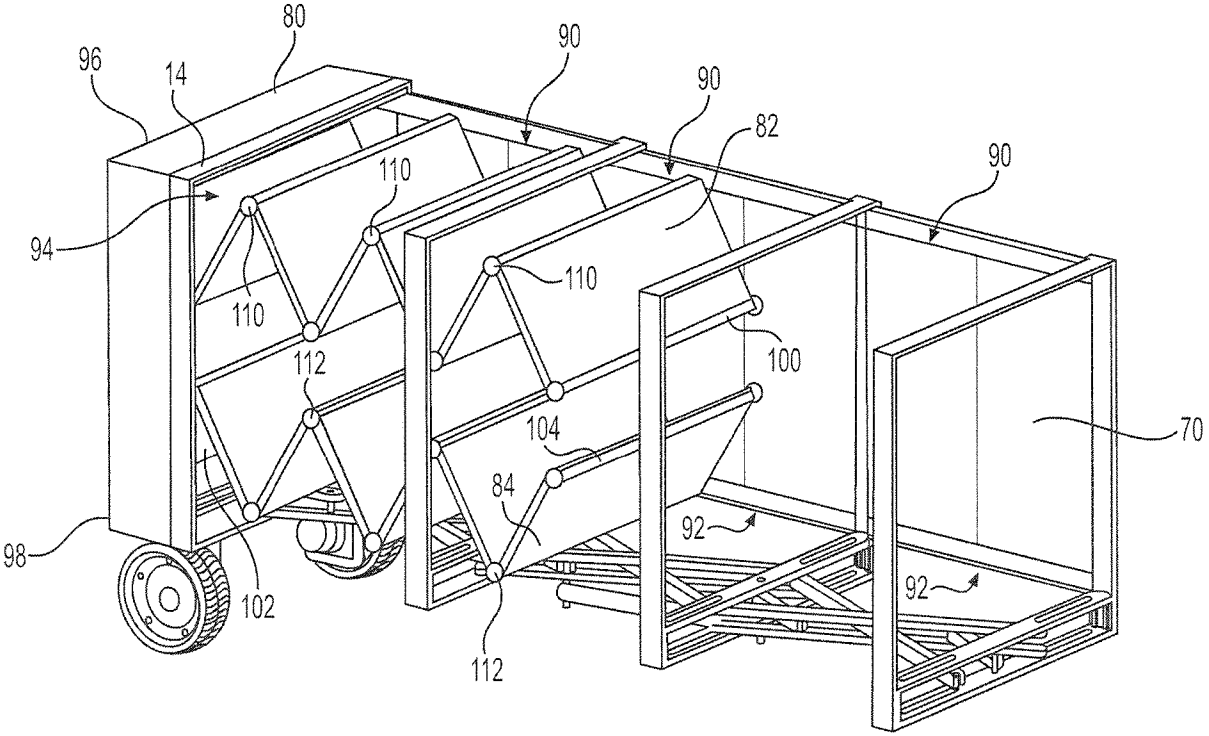
FIG. 8 is a partial perspective view of the portable collapsible container of FIG. 1, showing the scissors linkage assembly extended and showing both the top wall and the bottom wall partially extended from the rear member.
Figure 9:
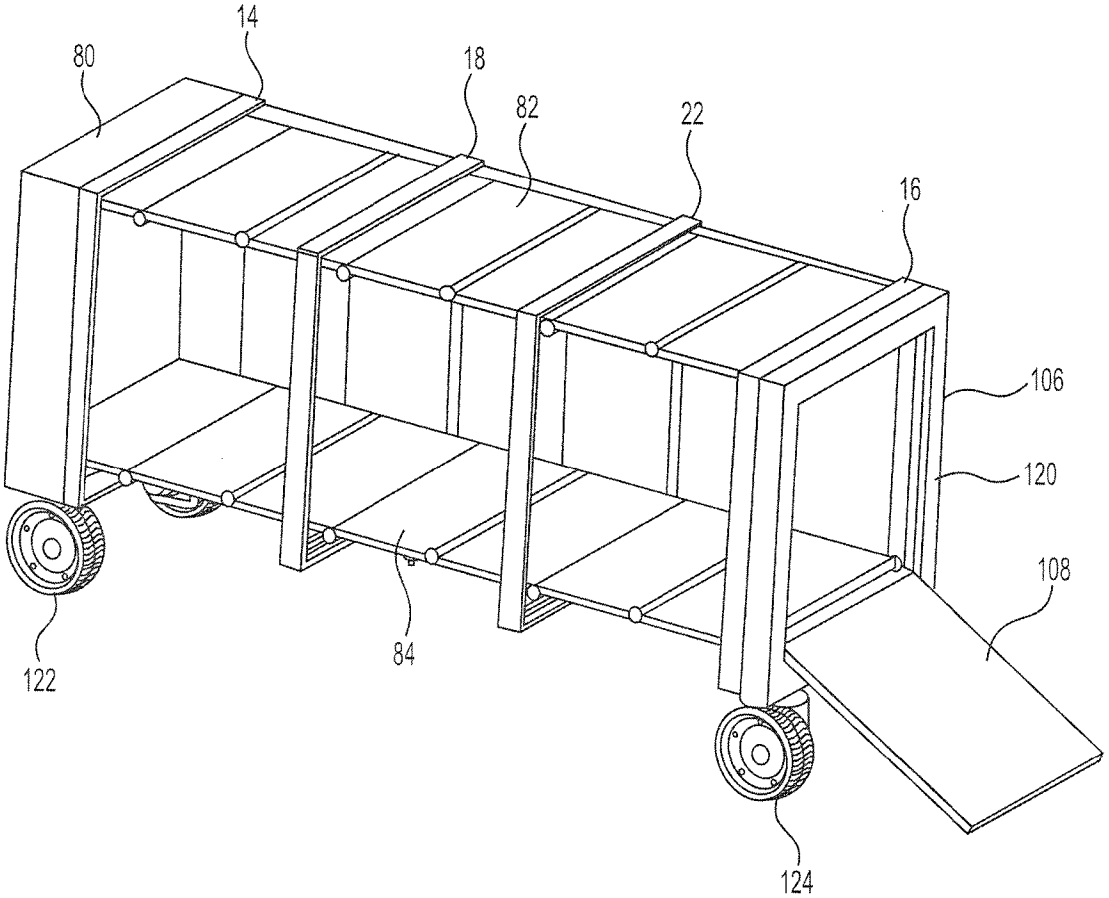
FIG. 9 is a perspective view of the portable collapsible container of FIG. 1, shown in the extended configuration with only a single sidewall mounted thereon to show details thereof, and with the front wall folded down to serve as a ramp.

Each of the hinged vertically extending panels 70 is mounted to, and extends between, adjacent ones of the plurality of open frames 14, 16, 18, 22. In FIGS. 6, 8 and 9, only one set of hinged vertically extending panels 70 is shown, i.e., in FIGS. 6, 8 and 9, one side of the portable collapsible container 10 appears open and uncovered. It should be understood that this is for purposes of clarity and illustration only. As shown in FIG. 1, a second set of hinged vertically extending panels 70 is provided, horizontally opposed from the set shown in FIGS. 6, 8 and 9, such that both sides of the portable collapsible container 10 are covered by a respective sidewall formed from the expanded hinged vertically extending panels 70.

As shown in FIG. 9, a first cover member 80 is secured to the first end frame 14 and a second cover member 106 is secured to the second end frame 16. The second cover member 106, as shown in FIG. 9, may include an open cover frame 120 and a door 108 pivotally secured thereto. Further, the first cover member 80 may have a set of wheels 122 rotatably mounted thereon and, similarly, the second cover member 106 may have a set of wheels 124 rotatably mounted thereon.

Figure 7:
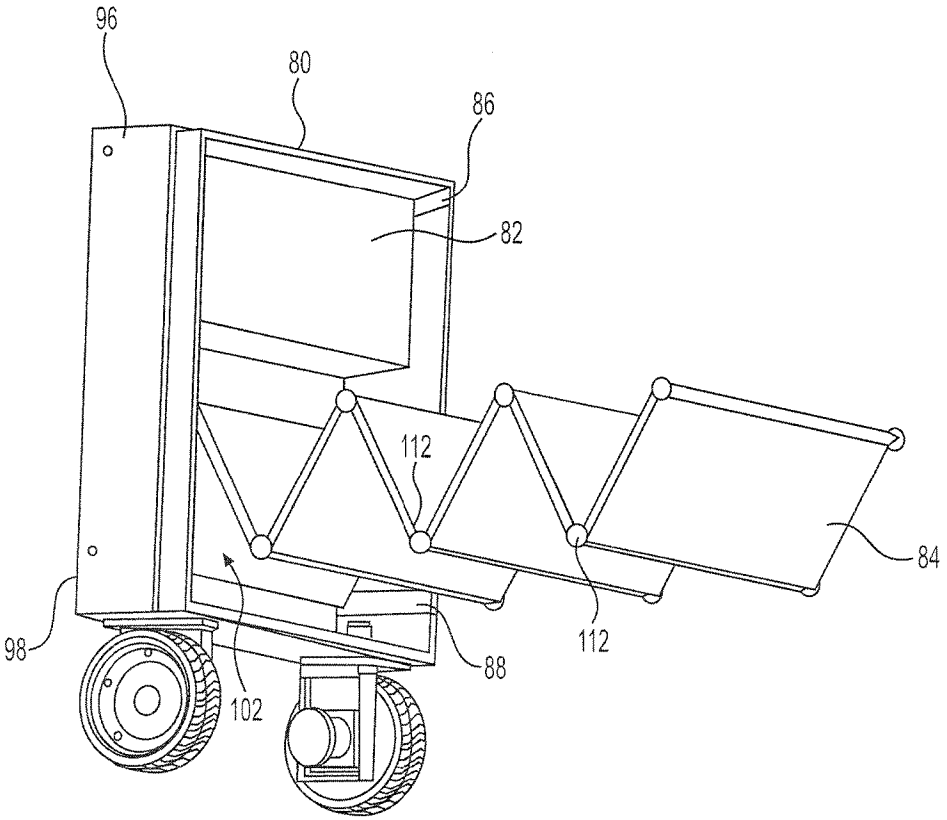
FIG. 7 is a perspective view of the box-shaped rear member of the portable collapsible container of FIG. 1, shown with the foldable top wall stored therein and the foldable bottom wall partially extended therefrom.

As best seen in FIGS. 7 and 8, a first end 94 of an upper foldable panel 82 is secured to an upper end 96 of the first cover member 80. A first end 102 of a lower foldable panel 84 is secured to a lower end 98 of the first cover member 80. The upper foldable panel 82 has a plurality of upper rollers 110 rotatably mounted thereon, and the lower foldable panel 84 also has a plurality of lower rollers 112 rotatably mounted thereon.

As shown in FIG. 8, the plurality of hinged vertically extending panels 70 each have a set of upper rails 90 and a set of lower rails 92 mounted thereon, such that the set of upper rails 90 receive the plurality of upper rollers 110, and the set of lower rails 92 receive the plurality of lower rollers 112. As shown in FIG. 7, similar upper and lower rails 86, 88 are mounted within first cover member 80, such that upper rails 86 form a continuous path of upper rails 90 and, similarly, lower rails 88 form a continuous path with lower rails 92.

As shown in FIG. 6, each of the plurality of hinged vertically extending panels 70 includes first and second sheets 72, 74, respectively. First sheet 72 has first and second vertically extending edges 76, 78, respectively, and second sheet 74 has first and second vertically extending edges 81, 83, respectively. The first vertically extending edge 76 of the first sheet 72 is pivotally secured to side member 42 of one of the plurality of open frames (such as open frame 14, for example), and the second vertically extending edge 83 of the second sheet 74 is pivotally secured to the side member 42 of a corresponding adjacent one of the plurality of open frames (such as open frame 18, for example). The second vertically extending edge 76 of the first sheet 72 is pivotally secured to the first vertically extending edge 81 of the second sheet 74.

Pulling the second cover member 106 away from the first cover member 80 expands the collapsible frame assembly 12 and deploys the plurality of hinged vertically extending panels 70 to form sidewalls of the portable collapsible container 10. The upper and lower foldable panels 82, 84 may then be deployed to form top and bottom walls of the portable collapsible container 10 by pulling their respective second ends 100, 104 in the direction of the second cover member 106. The rollers 110 of the upper foldable panel 82 travel smoothly and linearly through the upper set of rails 90, and the rollers 112 of the lower foldable panel 84 travel smoothly and linearly through the lower set of rails 92.

As shown in FIGS. 3 and 4, a linear actuator 64 may be provided to drive expansion and collapse of the collapsible frame assembly 12. Linear actuator 64 has opposed first and second ends, with the first end thereof being pivotally secured to the central portion 68 of the first linkage member 24 of one of the plurality of scissor linkages 20. The opposed second end is pivotally secured to the central portion 66 of the base end 44 of a corresponding one of the plurality of open frames (open frame 22 in the example of FIG. 4). It should be understood that linear actuator 64 may be installed between any two adjacent open frames. The linear actuator 64 may be a hydraulic, pneumatic, or electric cylinder with a piston extendable therefrom.

Figure 10:
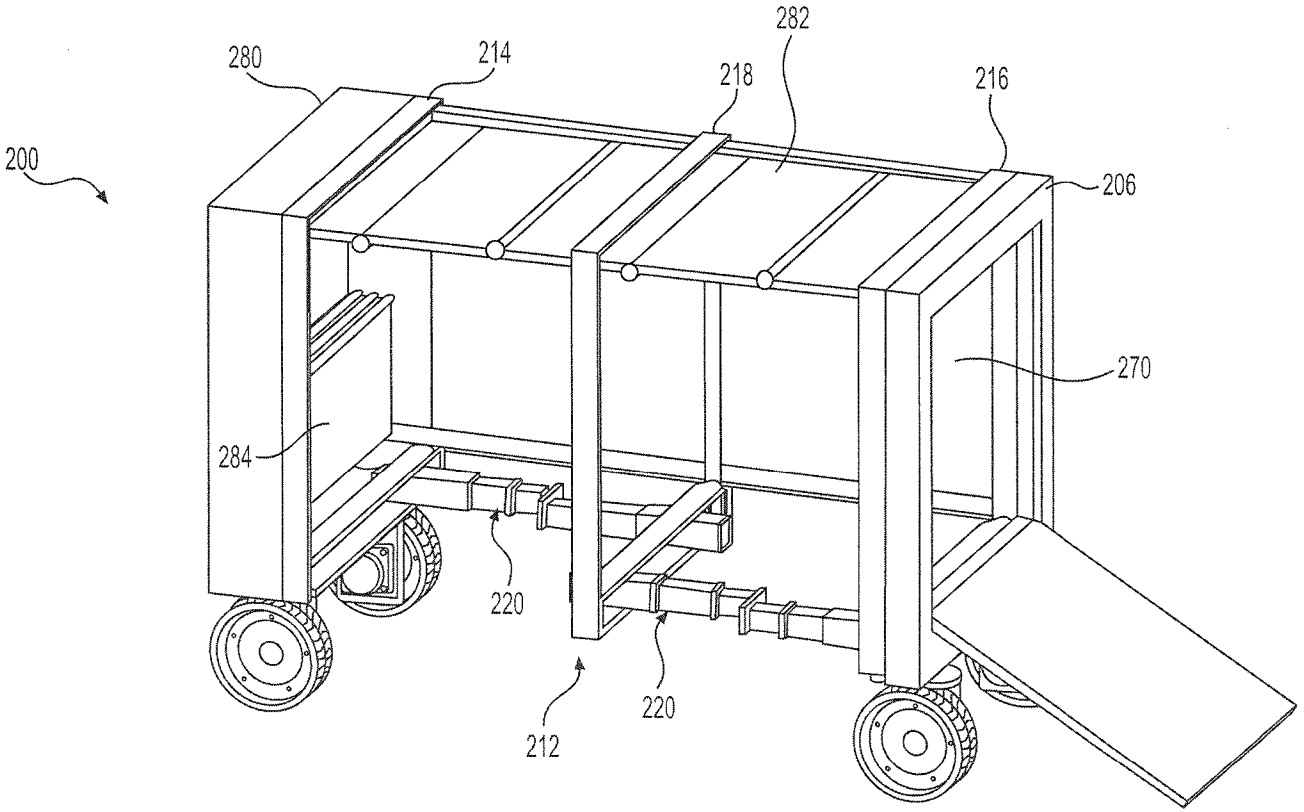
FIG. 10 is a partial perspective view of an alternative embodiment of a portable collapsible container having telescoping actuators in lieu of the scissors linkage.

The alternative embodiment of FIG. 10 is similar to the previous embodiment, the portable collapsible container 200 including a collapsible frame assembly 212 having a plurality of open frames 214, 216, 218, a plurality of hinged vertically extending panels 270, a first cover member 280, a second cover member 206, a lower foldable panel 284, and an upper foldable panel 282. However, as shown, the scissor linkages 20 of the previous embodiment have been replaced by corresponding telescoping actuators 220.

It is to be understood that the portable collapsible container is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A portable collapsible container, comprising:

a collapsible frame assembly, having:

a plurality of intermediate open frames disposed between opposed first and second end open frames, each of the open frames includes an upper end, a base end, and a pair of vertical side members, wherein each of the base ends includes a pair of parallel bars spaced vertically from each other forming a channel, each parallel bar includes a pair of horizontally aligned slots, the slots of one parallel bar are vertically aligned with the slots of the other parallel bar to which it is paired;

a plurality of scissor linkages, each said scissor linkage comprises first and second linkage members pivotally secured to one another, adjacent ones of the plurality of open frames and first and second end frames being adjustably coupled to one another by a respective one of the scissor linkages, wherein the first linkage member of each of the plurality of scissor linkages has opposed first and second ends, the second linkage member of each of the plurality of scissor linkages has opposed first and second ends, the first ends of the first and second linkage members of each of the plurality of scissor linkage being slidably mounted within the slots of the parallel bars of one open frame, the second ends thereof being slidably mounted within the slots of the parallel bars to a corresponding adjacent open frame; and a plurality of hinged vertically extending panels mounted to and extending between adjacent ones of the open frames;

a first cover member secured to the first end open frame;

an upper foldable panel having opposed first and second ends, the first end of the upper foldable panel being secured to an upper end of the first cover member;

a lower foldable panel having opposed first and second ends, the first end of the lower foldable panel being secured to a lower end of the first cover member; and a second cover member secured to the second end open frame.

2. The portable collapsible container as recited in claim 1, wherein each said open frame is rectangular.

3. The portable collapsible container as recited in claim 1, wherein said collapsible frame assembly further comprises a plurality of jib links, each of the jib links having opposed first and second ends, the first end being pivotally attached to a central portion of a base end of one of the of open frames, the second end thereof being pivotally attached to the first linkage member of the corresponding one of the scissor linkages attached to the same open frame as the jib link about midway between attachment of the scissor linkage to the open frame and pivotal connection of the linkage members of the scissor linkage.

4. The portable collapsible container as recited in claim 3, further comprising a linear actuator having opposed first and second ends, the first end of the linear actuator being pivotally attached to the central portion of the first linkage member of one of the plurality of scissor linkages, the second end of the linear actuator being pivotally attached to the central portion of the base end of a corresponding one of the plurality of open frames.

5. The portable collapsible container as recited in claim 1, wherein each of the plurality of hinged vertically extending panels comprises first and second sheets, each of the sheets having first and second vertically extending edges, the first vertically extending edge of the first sheet being pivotally attached to a vertically extending edge of one of the plurality of open frames, the second vertically extending edge of the second sheet being pivotally attached to the vertically extending edge of the corresponding adjacent open frame, the second vertically extending edge of the first sheet being pivotally attached to the first vertically extending edge of the second sheet.

6. The portable collapsible container as recited in claim 1, wherein the upper foldable panel has a plurality of upper rollers rotatably mounted thereon.

7. The portable collapsible container as recited in claim 6, wherein the lower foldable panel has a plurality of lower rollers rotatably mounted thereon.

8. The portable collapsible container as recited in claim 7, wherein each of the hinged vertically extending panels has a set of upper rails and a set of lower rails mounted thereon, the set of upper rails receiving the plurality of upper rollers, the set of lower rails receiving the plurality of lower rollers.

9. The portable collapsible container as recited in claim 1, wherein the second cover member comprises an open cover frame and a door pivotally secured thereto.

10. The portable collapsible container as recited in claim 1, wherein each of the first and second cover members has a set of wheels rotatably mounted thereon.

11. A portable collapsible container, comprising:

a collapsible frame assembly, having:

a plurality of open frames including opposed first and second end frames;

a plurality of scissor linkages, adjacent ones of the plurality of open frames being adjustably coupled to one another by a respective one of the scissor linkages, wherein each of the plurality of scissor linkages comprises first and second linkage members pivotally secured to one another, further wherein the first linkage member of each of the plurality of scissor linkages has opposed first and second ends, the second linkage member of each of the plurality of scissor linkages has opposed first and second ends, the first ends of the first and second linkage members of each of the plurality of scissor linkages being slidably mounted to one of the open frames, the second ends thereof being slidably mounted to a corresponding adjacent one of the open frames;

a plurality of jib links, each of the jib links having opposed first and second ends, the first end being pivotally attached to a central portion of a base end of one of the of open frames, the second end thereof being pivotally attached to the first linkage member of the corresponding one of the scissor linkages attached to the same open frame as the jib link about midway between attachment of the scissor linkage to the open frame and pivotal connection of the linkage members of the scissor linkage; and a plurality of hinged vertically extending panels mounted to and extending between adjacent ones of the open frames;

a first cover member secured to the first end frame;

an upper foldable panel having opposed first and second ends, the first end of the upper foldable panel being secured to an upper end of the first cover member;

a lower foldable panel having opposed first and second ends, the first end of the lower foldable panel being secured to a lower end of the first cover member; and a second cover member secured to the second end frame.

12. A portable collapsible container, comprising:

a collapsible frame assembly, having:

a plurality of open frames including opposed first and second end frames;

a plurality of scissor linkages, adjacent ones of the open frames being adjustably coupled to one another by a respective one of the plurality of scissor linkages, each of the scissor linkages having first and second linkage members pivotally attached to one another, the first linkage member of each of the scissor linkages having opposed first and second ends, the second linkage member of each of the scissor linkages having opposed first and second ends, the first ends of the first and second linkage members of each of the scissor linkages being slidably mounted to one of the open frames, the second ends thereof being slidably mounted to a corresponding adjacent one of the open frames;

a plurality of jib links, each of the jib links having opposed first and second ends, the first end being pivotally attached to a central portion of a base end of one of the of open frames, the second end thereof being pivotally attached to the first linkage member of the corresponding one of the scissor linkages attached to the same open frame as the jib link about midway between attachment of the scissor linkage to the open frame and pivotal connection of the linkage members of the scissor linkage; and a plurality of hinged vertically extending panels, each of the hinged vertically extending panels being mounted to and extending between adjacent ones of the open frames;

a first cover member secured to the first end frame, the first cover having an upper end and an opposed lower end;

an upper foldable panel having opposed first and second ends, the first end of the upper foldable panel being secured to the upper end of the first cover member;

a lower foldable panel having opposed first and second ends, the first end of the lower foldable panel being secured to the lower end of the first cover member; and a second cover member secured to the second end frame.

13. The portable collapsible container as recited in claim 12, wherein each said open frame is rectangular.

14. The portable collapsible container as recited in claim 12, further comprising a linear actuator having opposed first and second ends, the first end thereof being pivotally attached to the central portion of the first linkage member of one of the scissor linkages, the second end being pivotally attached to the central portion of the base end of a corresponding one of the open frames.

15. The portable collapsible container as recited in claim 12, wherein each of the plurality of hinged vertically extending panels comprises first and second sheets, each of the sheets having first and second vertically extending edges, the first vertically extending edge of the first sheet being pivotally attached to a vertically extending edge of one of the plurality of open frames, the second vertically extending edge of the second sheet being pivotally attached to the vertically extending edge of the corresponding adjacent open frame, the second vertically extending edge of the first sheet being pivotally attached to the first vertically extending edge of the second sheet.

16. The portable collapsible container as recited in claim 12, wherein the upper foldable panel has a plurality of upper rollers rotatably mounted thereon, and wherein the lower foldable panel has a plurality of lower rollers rotatably mounted thereon, the plurality of hinged vertically extending panels each having a set of upper rails and a set of lower rails mounted thereon, the set of upper rails receiving the plurality of upper rollers, the set of lower rails receiving the plurality of lower rollers.

17. The portable collapsible container as recited in claim 12, wherein the second cover member comprises an open cover frame and a door pivotally secured thereto.

18. The portable collapsible container as recited in claim 12, wherein each of the first and second cover members has a set of wheels rotatably mounted thereon.

* * * * *